US008301066B2

(12) United States Patent
Kono et al.

(10) Patent No.: US 8,301,066 B2
(45) Date of Patent: Oct. 30, 2012

(54) FIXING DEVICE CONFIGURATION FOR AN IMAGE FORMING APPARATUS

(75) Inventors: Masayuki Kono, Ebina (JP); Takahito Chiba, Ebina (JP); Tomoyuki Ito, Ashigarakami-gun (JP); Satoshi Hasebe, Ashigarakami-gun (JP); Yuichi Fukuda, Ebina (JP); Mitsuhiro Matsumoto, Ebina (JP); Toshiyuki Miyata, Ebina (JP); Junpei Amano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 267 days.

(21) Appl. No.: 12/705,321

(22) Filed: Feb. 12, 2010

(65) Prior Publication Data

US 2011/0064491 A1 Mar. 17, 2011

(30) Foreign Application Priority Data

Sep. 16, 2009 (JP) ..... 2009-214190

(51) Int. Cl.
*G03G 15/20* (2006.01)

(52) U.S. Cl. ..... 399/323; 399/329

(58) Field of Classification Search ..... 399/329, 399/323
See application file for complete search history.

(56) References Cited

U.S. PATENT DOCUMENTS 5,778,294 A * 7/1998 Hiraoka et al. ..... 399/329
7,333,762 B2 * 2/2008 Oishi et al. ..... 399/329
7,447,474 B2 * 11/2008 Fujino ..... 399/329
7,463,857 B2 * 12/2008 Baba et al. ..... 399/323
7,801,473 B2 * 9/2010 Ando ..... 399/323
7,970,330 B2 * 6/2011 Condello et al. ..... 399/329
2005/0185996 A1 * 8/2005 Oishi et al. ..... 399/329
2006/0147231 A1 * 7/2006 Aruga et al. ..... 399/329
2006/0245800 A1 * 11/2006 Fujino ..... 399/329
2007/0048035 A1 * 3/2007 Baba et al. ..... 399/323
2008/0124146 A1 * 5/2008 Bae et al. ..... 399/329
2010/0178085 A1 * 7/2010 Keenan et al. ..... 399/323
(Continued)

FOREIGN PATENT DOCUMENTS

EP 1 617 302 A2 1/2006
(Continued)

OTHER PUBLICATIONS

Extended European Search Report issued in European Application No. 10156189.2 dated Jul. 17, 2012.

*Primary Examiner* — David Gray
*Assistant Examiner* — G. M. Hyder
(74) *Attorney, Agent, or Firm* — Sughrue Mion, PLLC

(57) ABSTRACT

A fixing device includes: a belt member provided to be circularly movable having a width; a first fixing member disposed inside the belt member; a second fixing member disposed in press contact with the first fixing member across the belt member, and forms a passing portion with the belt member, through which a recording medium passes; and a pressing member disposed along a width direction of the belt member and downstream of the passing portion in a moving direction of the belt member, in which the pressing member has a surface and brings the surface in contact with an inner peripheral surface of the belt member to press the belt member against the second fixing member. The surface is curved toward the second fixing member along with a move from an end portion to a center portion in a longitudinal direction of the pressing member.

16 Claims, 7 Drawing Sheets

U.S. PATENT DOCUMENTS

| | | | | |
|---|---|---|---|---|
| 2011/0064492 | A1* | 3/2011 | Ichikawa et al. | 399/329 |
| 2011/0081173 | A1* | 4/2011 | Watanabe et al. | 399/323 |
| 2011/0135357 | A1* | 6/2011 | Okabayashi et al. | 399/329 |

FOREIGN PATENT DOCUMENTS

| | | | |
|---|---|---|---|
| EP | 1 925 989 | A2 | 5/2008 |
| JP | 2006-317771 | A | 11/2006 |
| JP | 2007-121363 | A | 5/2007 |
| JP | 2007-178637 | A | 7/2007 |
| JP | 2008-122849 | A | 5/2008 |

* cited by examiner

FIXING DEVICE CONFIGURATION FOR AN IMAGE FORMING APPARATUS

CROSS REFERENCE TO RELATED APPLICATIONS

This application is based on and claims priority under 35 USC §119 from Japanese Patent Application No. 2009-214190 filed Sep. 16, 2009.

BACKGROUND

1. Technical Field

The present invention relates to a fixing device and an image forming apparatus.

2. Related Art

Many types of fixing devices for fixing an unfixed toner image formed on a sheet medium have been known.

SUMMARY

According to an aspect of the present invention, there is provided a fixing device including: a belt member provided to be circularly movable having a width; a first fixing member disposed inside the belt member; a second fixing member that is disposed to be in press contact with the first fixing member across the belt member, and forms a passing portion between the belt member and the second fixing member, through which a recording medium passes; and a pressing member that is disposed along a direction of the width of the belt member and disposed downstream of the passing portion in a moving direction of the belt member, the pressing member having a surface and bringing the surface in contact with an inner peripheral surface of the belt member to press the belt member against the second fixing member, wherein the surface is curved toward the second fixing member along with a move from an end portion to a center portion in a longitudinal direction of the pressing member.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention will be described in detail with reference to the attached drawings.

Figure 1:
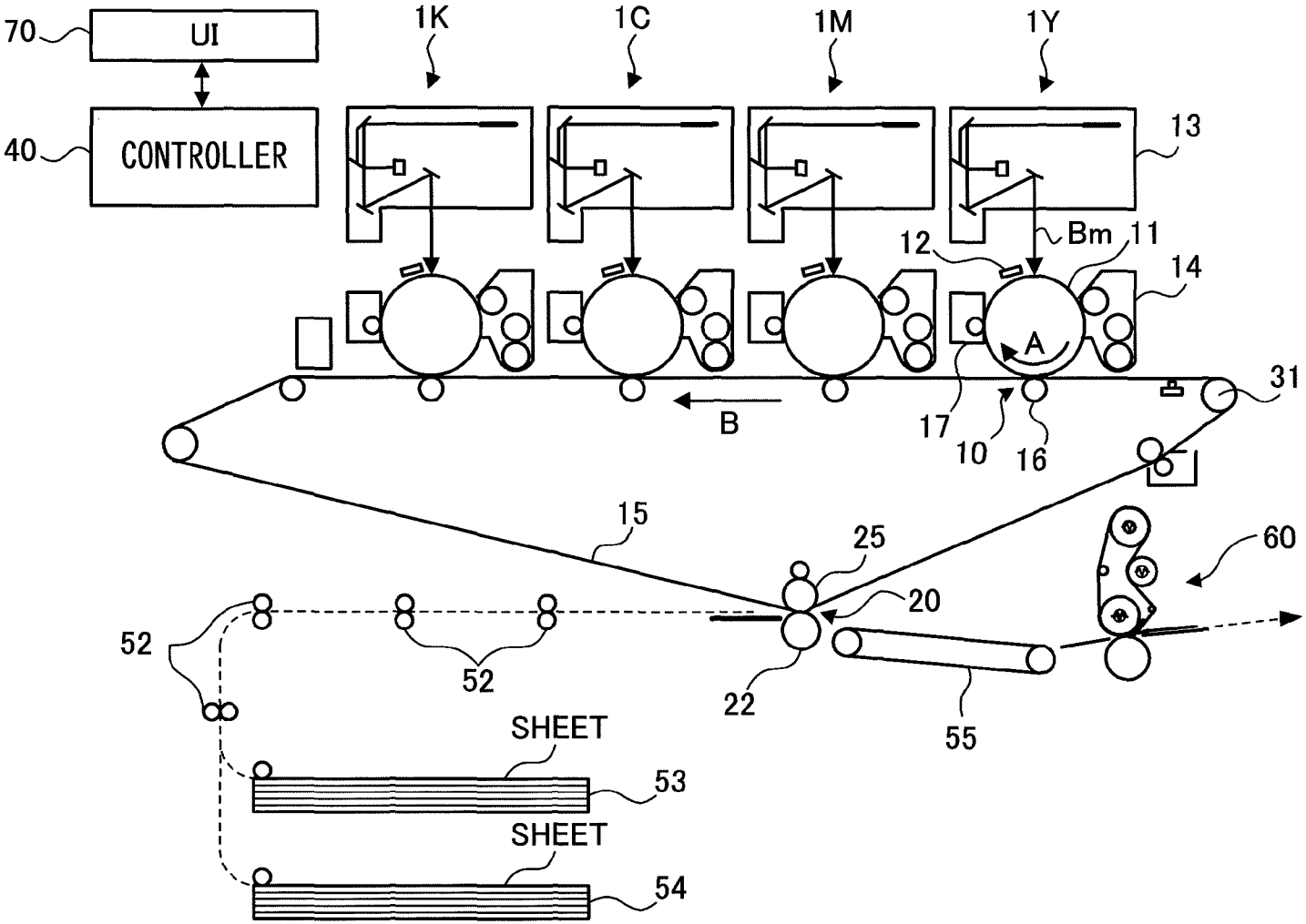
FIG. 1 is a schematic block diagram showing an image forming apparatus to which an exemplary embodiment is applied.

FIG. 1 is a schematic block diagram showing an image forming apparatus to which the exemplary embodiment is applied. The image forming apparatus shown in FIG. 1 is an image forming apparatus of an intermediate transfer system generally called a tandem type. In this image forming apparatus, plural image forming units 1Y, 1M, 1C and 1K are provided and each unit forms a toner image of a corresponding color component by an electrophotographic system. A primary transfer part 10 is also provided to sequentially transfer (primarily transfer) the toner images of the respective color components formed by the image forming units 1Y, 1M, 1C and 1K to an intermediate transfer belt 15.

The image forming apparatus further has a secondary transfer part 20 that collectively transfers (secondarily transfers) the superimposed toner images transferred to the intermediate transfer belt 15 to a sheet, which is an example of a recording medium. A fixing device 60 for fixing the secondarily-transferred toner images to the sheet is also provided. Still further, there are provided a controller 40 for controlling operation of each device (each part) and a user interface (UI) 70 composed of a display panel and the like to receive information from a user and to display information to a user. Here, the image forming units 1Y, 1M, 1C and 1K, the intermediate transfer belt 15, the secondary transfer part 20 and the like may be integrally captured as an image forming unit for forming an image on a sheet.

In this exemplary embodiment, the following electrophotographic devices are disposed in each of the image forming units 1Y, 1M, 1C and 1K. A charging device 12 for charging a photoconductive drum 11 is mounted around the periphery of the photoconductive drum 11 that rotates in the direction of arrow A. A laser exposure device 13 is also provided, above the photoconductive drum 11, to form an electrostatic latent image (an exposure beam is shown by a reference Bm in the figure). Further, a developing device 14 that accommodates toner of each color component and visualizes the electrostatic latent image with the toner is also disposed. Still further a primary transfer roll 16 is provided for transferring the toner images of the respective color components formed on the photoconductive drum 11 to the intermediate transfer belt 15 at the primary transfer part 10. A drum cleaner 17 for removing residual toner on the photoconductive drum 11 is further provided.

The intermediate transfer belt 15 is circularly moved at a predetermined speed in a direction of arrow B shown in FIG. 1 by a drive roll 31 which is driven by a motor (not shown) having an excellent constant speed control property. The primary transfer part 10 includes the primary transfer roll 16 disposed to face the photoconductive drum 11 across the intermediate transfer belt 15. The toner images on the respective photoconductive drums 11 are electrostatically attracted to the intermediate transfer belt in sequence, thereby forming the superimposed toner images on the intermediate transfer belt 15. The secondary transfer part 20 includes a secondary transfer roll 22 disposed at a side of a toner image carrying surface of the intermediate transfer belt 15 and a backup roll 25. The secondary transfer roll 22 is disposed in press contact with the backup roll 25 across the intermediate transfer belt 15. Further, the secondary transfer roll 22 is grounded, and a secondary transfer bias is generated between the secondary transfer roll 22 and the backup roll 25 to secondarily transfer the toner images to a sheet transported to the secondary transfer part 20.

Next, a basic image forming process of the image forming apparatus to which this exemplary embodiment is applied will be described. In the image forming apparatus shown in FIG. 1, image data is outputted from an image reading device and the like, which is not shown. The image data is subjected to image processing by an image processing device, which is not shown, to be converted into grey level data of coloring materials of four colors, Y, M, C and K, and then outputted to the laser exposure device 13.

The laser exposure device 13 irradiates the photoconductive drum 11 of each of the image forming units 1Y, 1M, 1C and 1K with an exposure beam Bm emitted by, for example, a semiconductor laser in response to the inputted grey level data of coloring materials. In each photoconductive drum 11, the surface is charged by the charging device 12, and then exposed by the laser exposure device 13 to form the electrostatic latent image. The developing device 14 forms the toner image on the photoconductive drum 11, and the toner image is transferred to the intermediate transfer belt 15 at the primary transfer part 10 where each photoconductive drum 11 contacts the intermediate transfer belt 15.

After the toner images are primarily transferred to the surface of the intermediate transfer belt 15 in sequence, the toner images are transported to the secondary transfer part 20 by movement of the intermediate transfer belt 15. In the secondary transfer part 20, the secondary transfer roll 22 is pressed against the backup roll 25 across the intermediate transfer belt 15. Then a sheet transported by transporting rolls 52 and the like from a first sheet storage part 53 or a second sheet storage part 54 is inserted between the intermediate transfer belt 15 and the secondary transfer roll 22. The unfixed toner images carried on the intermediate transfer belt 15 are electrostatically transferred to the sheet collectively at the second transfer part 20. The sheet on which the toner images have been electrostatically transferred is stripped from the intermediate transfer belt 15, and fed to a transporting belt 55 provided downstream of the secondary transfer roll 22 in the sheet transporting direction. The transporting belt 55 transports the sheet to the fixing device 60.

The fixing device 60 will be described next.

Figure 2B:
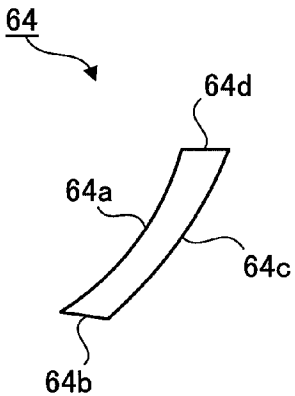
FIGS. 2A and 2B are side cross-sectional views showing a schematic configuration of a fixing device.
Figure 2A:
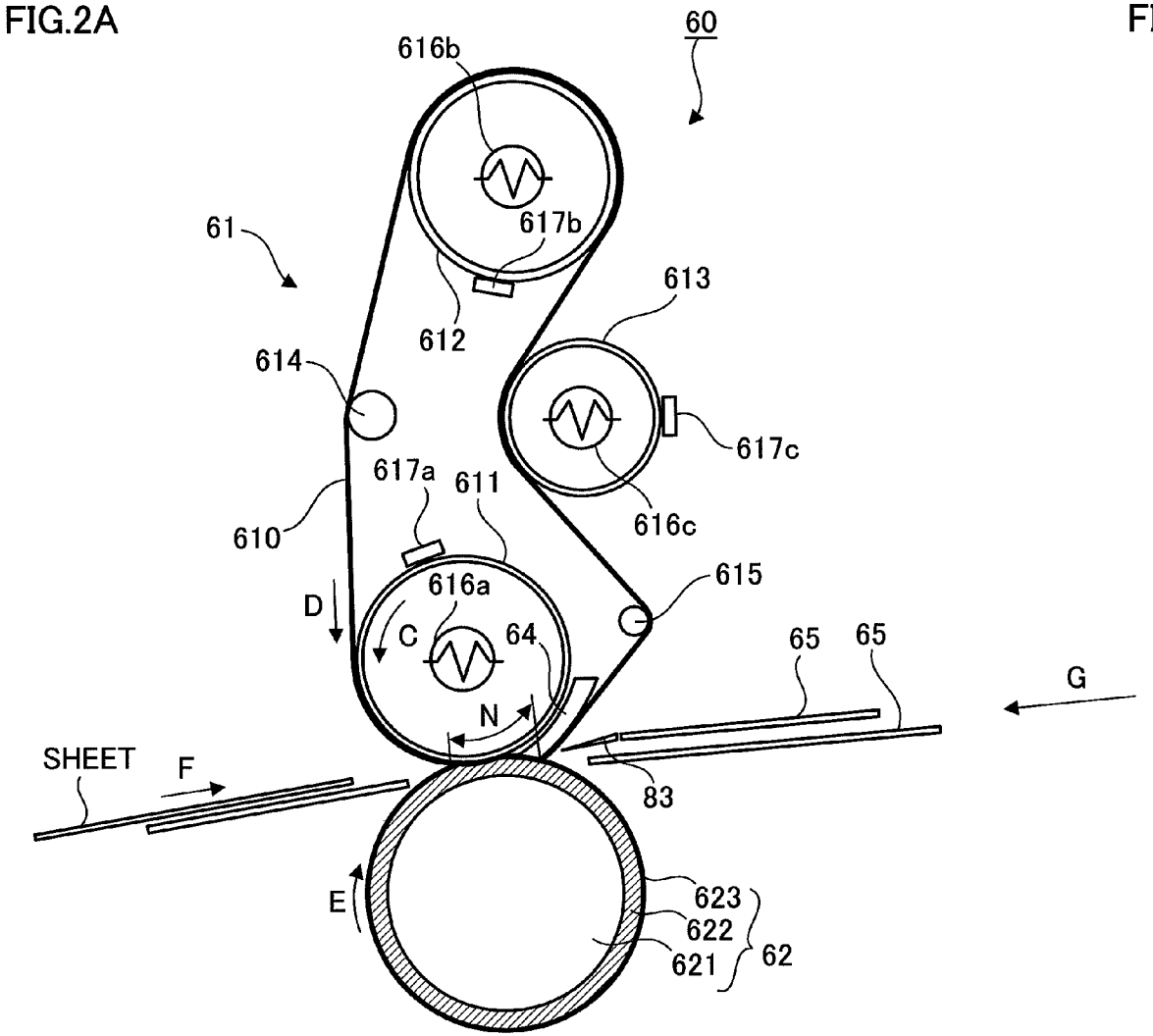
Figure 3A:
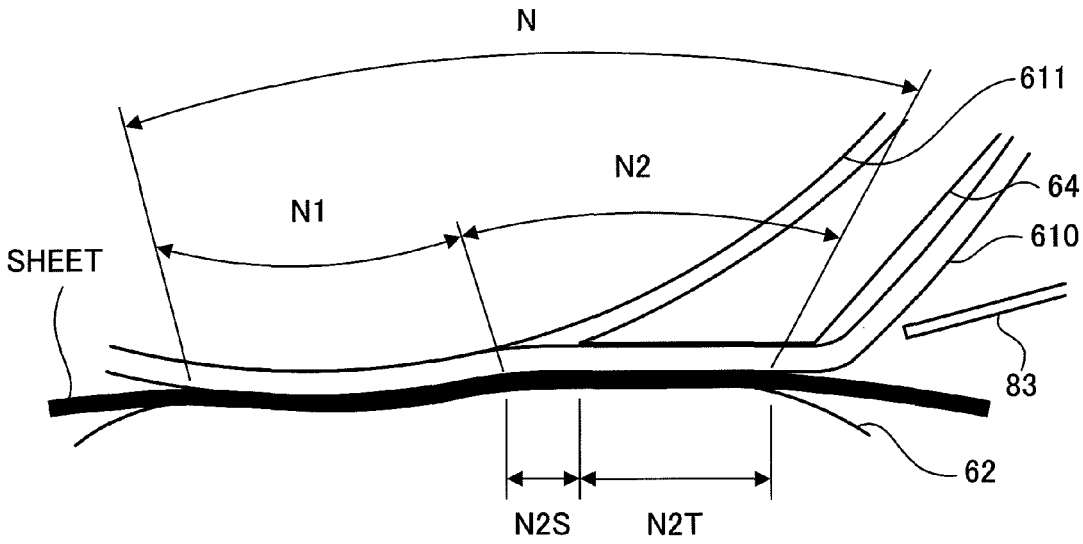
FIGS. 3A and 3B illustrate a nip portion.
Figure 3B:
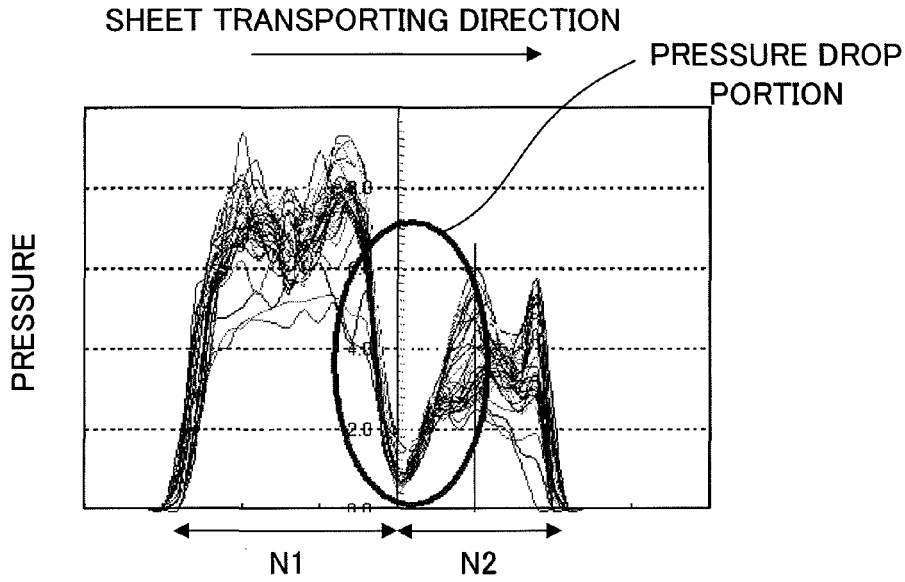

FIGS. 2A and 2B are side cross-sectional views showing a schematic configuration of the fixing device 60. FIGS. 3A and 3B illustrate a nip portion N.

As shown in FIG. 2A, the main part of the fixing device 60 is composed of a fixing belt module 61 with a fixing belt 610 and a pressure roll 62 provided in press contact with the fixing belt module 61. The fixing device 60 also has a nip portion N between the fixing belt module 61 and the pressure roll 62, where toner images are fixed to a sheet by heat and pressure.

The fixing belt module 61 has a fixing belt 610 (an example of a belt member) which is formed in an endless shape and configured to be circularly movable, a fixing roll 611 (an example of a first fixing member) which is provided inside of the fixing belt 610 and circularly drives the fixing belt 610 while providing tension to the fixing belt 610 and a first tension roll 612 which provides tension to the fixing belt 610 from the inside thereof. The fixing belt module 61 also has a second tension roll 613 which is disposed outside of the fixing belt 610 to define a circular route of the fixing belt 610 and an attitude correction roll 614 that corrects the attitude of the fixing belt 610 at a position between the fixing roll 611 and the first tension roll 612. The fixing belt module 61 further includes a stripping pad 64 disposed in an area in the downstream side within a nip portion N where the fixing belt module 61 and the pressure roll 62 are in press contact, and a third tension roll 615 that provides tension to the fixing belt 610 at a downstream side of the nip portion N. Still further, a drive motor (not shown) is provided to circularly drive the fixing roll 611 in a direction of arrow C in the figure.

The fixing belt 610 is a flexible endless belt having a peripheral length of about 314 mm and a width of about 340 mm. The fixing belt 610 is composed of a base layer formed of polyimide resin of about 80 μm thickness, an elastic layer laminated on the surface side (outer peripheral surface side) of the base layer formed of silicone rubber with the thickness of about 450 μm, and further a release layer formed of a PFA (tetrafluoroethylene/perfluoroalkyl vinyl ether copolymer resin) tube with a thickness of about 35 μm coated on the elastic layer. The elastic layer is provided to improve image quality, especially, of a color image. As for the configuration of the fixing belt 610, materials, thicknesses or hardness may be selected depending on machine design conditions such as an intended purpose and conditions of use. The fixing belt 610 rotates at a predetermined speed in the direction of arrow D in FIG. 2A by the rotation of the fixing roll 611.

The fixing roll 611 is formed to have a hollow body. Specifically, the fixing roll 611 is a hard roll in which a coating of fluorine resin with a thickness of about 200 μm is formed on a cylindrical core roll as a protective layer for preventing wearing in a surface of the cylindrical core roll made of aluminum with an outer diameter of about 65 mm, length of about 360 mm and thickness of about 10 mm. However, the configuration of the fixing roll 611 is not limited thereto; the fixing roll 11 may have any configuration that functions as a roll having sufficient hardness to the degree that deformation is rarely observed in the fixing roll 611 though a pressing force is exerted by the pressure roll 62 when the nip portion N is formed between the fixing roll 611 and the pressure roll 62. The fixing roll 611 rotates at a surface speed of, for example, about 440 mm/s in the direction of arrow C due to a driving force from a drive motor (not shown).

Inside the fixing roll 611, a first halogen heater 616*a* (a heat source) rated at 900 W is provided. The fixing roll 611 is controlled to have a surface temperature of about 150° C. based on a measurement value of a first temperature sensor 617*a* disposed to be in contact with the surface of the fixing roll 611.

The first tension roll 612 is substantially a cylindrical roll made of aluminum with an outer diameter of about 30 mm, a thickness of about 2 mm and a length of about 360 mm. Inside the first tension roll 612, a second halogen heater 616*b* rated at 1000 W is provided as a heat source. The first tension roll 612 is controlled to have a surface temperature of about 190° C. based on a measurement value of a second temperature sensor 617*b* disposed to be in contact with the surface of the first tension roll 612. Accordingly, the first tension roll 612 has a function to heat the fixing belt 610 from the inside, as well as to provide tension to the fixing belt 610.

At each of both ends of the first tension roll 612, a spring member (not shown) is provided to press the first tension roll 612 toward the outside of the fixing belt 610; thereby setting a total tension of the fixing belt 610 to about 15 kgf. To maintain the tension of the fixing belt 610 substantially constant in the width direction thereof and to suppress displacement of the fixing belt 610 in the axis direction thereof as small as possible, the first tension roll 612 has an outer diameter at a center portion which is about 100 μm larger than an outer diameter at the end portions; that is, the first tension roll 612 is formed to have substantially a crown portion.

The second tension roll 613 is substantially a cylindrical roll made of aluminum with an outer diameter of about 25 mm, a thickness of about 2 mm and a length of about 360 mm. On the surface of the second tension roll 613, a release layer made of fluorine resin with a thickness of about 20 μm is formed. The release layer is formed to prevent deposition of toner or paper debris, having been adhered to the peripheral surface of the fixing belt 610, on the second tension roll 613. Like the first tension roll 612, the second tension roll 613 is formed to have substantially a crown portion, in which an outer diameter at a center portion is about 100 μm larger than an outer diameter at the end portions. Not that both first tension roll 612 and second tension roll 613 are formed to have substantially a crown portion, either the first tension roll 612 or the second tension roll 613 may be formed to have substantially a crown portion.

Inside the second tension roll 613, a third halogen heater 616*c* rated at 1000 W is provided. The second tension roll 613 is controlled to have a surface temperature of about 190° C. based on a measurement value of a third temperature sensor 617*c* disposed to be in contact with the surface of the second tension roll 613. Accordingly, the second tension roll 613 has a function to heat the fixing belt 610 from the outer peripheral surface side, as well as to provide tension to the fixing belt 610. That is to say, this exemplary embodiment has a configuration in which the fixing belt 610 is heated by the fixing roll 611, the first tension roll 612 and the second tension roll 613.

The attitude correction roll 614 is substantially a cylindrical roll made of aluminum with an outer diameter of about 15 mm and a length of about 360 mm.

In the fixing device 60, a belt edge position detection mechanism (not shown) for detecting a position of an edge of the fixing belt 610 is provided. The attitude correction roll 614 is provided with a shifting mechanism that shifts a position in contact with the fixing belt 610 in the axial direction thereof in response to the detection result of the belt edge position detection mechanism, thereby controlling walk of the fixing belt 610 in this exemplary embodiment.

The stripping pad 64, as an example of a pressing member, is substantially a block-like member formed of a rigid body such as resin or metal, for example SUS, with a length corresponding to that of the fixing roll 611 in the axial direction, and disposed along the width direction of the fixing belt 610. The stripping pad 64 has, as shown in FIG. 2B, an inside surface 64*a* that faces the fixing roll 611, a pressing surface 64*b* that contacts an inner peripheral surface of the fixing belt 610 and presses the fixing belt 610 against the pressure roll 62, an outside surface 64*c* that forms an angle with the pressing surface 64*b* to sharply turn the moving direction of the fixing belt 610 (bend the fixing belt 610) and an upper surface 64*d*, and the stripping pad 64 is substantially arc-shaped in cross section.

The stripping pad 64 is provided downstream of an area (roll nip portion N1, refer to FIG. 3A) in the moving direction of the fixing belt 610, where the pressure roll 62 presses in contact with the fixing roll 611 across the fixing belt 610, throughout the whole area in the axial direction of the fixing roll 611. The stripping pad 64 is supported at both ends thereof. Specifically, each of both ends of the stripping pad 64 is supported by an arm (not shown) swingably mounted around a support shaft (not shown) of the fixing roll 611. Further, the stripping pad 64 is urged by an urging unit which is not shown, such as a spring, to press the fixing belt 610 against the pressure roll 62 with a predetermined load (for example, about 10 kgf). Accordingly, a stripping pad nip portion N2 (refer to FIG. 3A) having a width of, for example, about 5 mm is formed along the moving direction of the fixing belt 610.

The third tension roll 615 is substantially a cylindrical roll made of aluminum with an outer diameter of about 12 mm and a length of about 360 mm. The third tension roll 615 is disposed downstream of the stripping pad 64 in the moving direction of the fixing belt 610 so that the fixing belt 610 having passed the stripping pad 64 may smoothly move toward the second tension roll 613.

The pressure roll 62 is a soft roll composed of a cylindrical roll 621 made of aluminum with a diameter of about 45 mm and a length of about 360 mm as a base, and an elastic layer 622 formed of silicone rubber having a JIS (Japanese Industrial Standard)—A hardness of 30° with a thickness of about 10 mm and a release layer 623 formed by PFA tube with a thickness of abut 100 μm laminated on the base in this order. The pressure roll 62 is disposed along the width direction of the fixing belt 610.

The pressure roll 62 is provided in press contact with a portion of the fixing belt 610, which is winding around the fixing roll 611, by an urging unit such as a spring, which is not shown, as well as rotatably supported.

Accordingly, a roll nip portion N1 (refer to FIG. 3A) is formed at the portion where the pressure roll 62 is pressed against the fixing roll 611 across the fixing belt 610. The pressure roll 62 rotates in the direction of arrow E following the rotation of the fixing roll 611 of the fixing belt module 61 in the direction of arrow C. The pressure roll 62 is not provided with any heat source, such as a halogen heater, inside thereof. Here, the pressure roll 62 may be captured as a second fixing member that is provided in press contact with the fixing roll 611 across the fixing belt 610 to form the roll nip portion N1, as an example of a passing portion, with the fixing belt 610 through which a sheet, as an example of a recording medium, passes.

The fixing device 60 guides the sheet carrying a toner image transported in the direction of arrow F shown in FIG. 2A to the nip portion N, and fixes the toner image to the sheet by heat and pressure applied mainly at the roll nip portion N1 (refer to FIG. 3A). The heat applied in the nip portion N is supplied mainly by the fixing belt 610. The fixing belt 610 is subjected to heat supplied from the first halogen heater 616*a* disposed inside the fixing roll 611 via the fixing roll 611, heat supplied from the second halogen heater 616*b* disposed inside the first tension roll 612 via the first tension roll 612, and heat supplied from the third halogen heater 616*c* disposed inside the second tension roll 613 via the second tension roll 613. In this exemplary embodiment, heat energy is supplied to the fixing belt 610 from the first tension roll 612 and the second tension roll 613, in addition to the fixing roll 611, not to cause a decrease in temperature in the nip portion N even at a process speed of about 440 mm/s.

As described above, the fixing roll 611, which is one of the members for forming the roll nip portion N1, is a hard roll made of aluminum, and the other member, namely, the pressure roll 62 is a soft roll coated with the elastic layer 622. Accordingly, the roll nip portion N1 in this exemplary embodiment is formed by deformation of the elastic layer 622 of the pressure roll 62. In the roll nip portion N1, the fixing roll 611 around which the fixing belt 610 is wound hardly deforms; and therefore, the rotating radius of the fixing belt 610 which moves along the surface of the fixing roll 611 does not substantially vary. Thereby the fixing belt 610 passes through the roll nip portion N1 while maintaining the moving speed substantially constant.

After passing through the roll nip portion N1, the sheet moves to the stripping pad nip portion N2. At an outlet of the stripping pad nip portion N2, the fixing belt 610 moves from the pressing surface 64*b* to the outer peripheral surface 64*c* such that the fixing belt 610 wraps around the stripping pad 64 (refer to FIGS. 2A and 2B), and the fixing belt 610 sharply turns in the moving direction thereof to be directed toward the third tension roll 615. Therefore, the sheet having passed the stripping pad nip portion N2 becomes unable to follow the turning of the fixing belt 610 in the moving direction thereof at the time of exit from the stripping pad nip portion N2. Then the sheet is spontaneously stripped from the fixing belt 610 due to the stiffness of the sheet. In short, the sheet is reliably separated from the fixing belt 610 at the time that the sheet exits from the stripping pad nip portion N2. The sheet separated from the fixing belt 610 is guided in a moving direction thereof by a stripping guide plate 83 disposed downstream of the stripping pad nip portion N2. Then the sheet guided by the stripping guide plate 83 is outputted to the outside of the device by an exit guide 65 and exit rolls (not shown), thereby finishing the fixing process.

In this exemplary embodiment, a pad mounted area N2T (refer to FIG. 3A) is set within the pad nip portion N2, where the stripping pad 64 is mounted (a portion in which the stripping pad 64 and the pressure roll are in press contact). Between the pad mounted area N2T and the roll nip portion N1, a boundary area N2S (also refer to FIG. 3A) is formed. In the boundary area N2S, there is no member that presses the fixing belt 610; and therefore the fixing belt 610 is pressed in contact with the pressure roll 62 only by the tension. Accordingly, a nip pressure in the boundary area N2S is relatively lower than those in the roll nip portion N1 and the pad mounted area N2T. As a result, as shown in FIG. 3B, a pressure drop portion where the nip pressure is lower is formed at the upstream side (boundary area N2S) in the sheet transporting direction within the stripping pad nip portion N2.

In the fixing process by the fixing device 60 of this exemplary embodiment, a sheet on which a toner image is formed is heated and pressurized in the roll nip portion N1. In some cases, water content in the sheet subjected to heat is vaporized, thereby forming water vapor in the roll nip portion N1 at that time. Since high nip pressure is applied in the roll nip portion N1, no bubble (air gap) caused by water vapor is formed between the fixing belt 610 and the pressure roll 62.

However, in the case where the boundary area N2S (pressure drop portion) is formed as described above, water vapor tends to be formed in the boundary area N2S. When the sheet, with the water vapor formed, enters the pad mounted area N2T where high nip pressure is applied, the water vapor (bubble) formed in the boundary area N2S moves around on the surface of the sheet due to the high nip pressure. Here, since the sheet just passed through the roll nip portion N1, the toner image on the sheet is melted and not completely solidified. Accordingly, there occurs a phenomenon in which the toner image is distorted by bubbles moving around. As a result, image defect will be led in which minute holes or inconsistencies occur in the fixed image.

Figure 4:
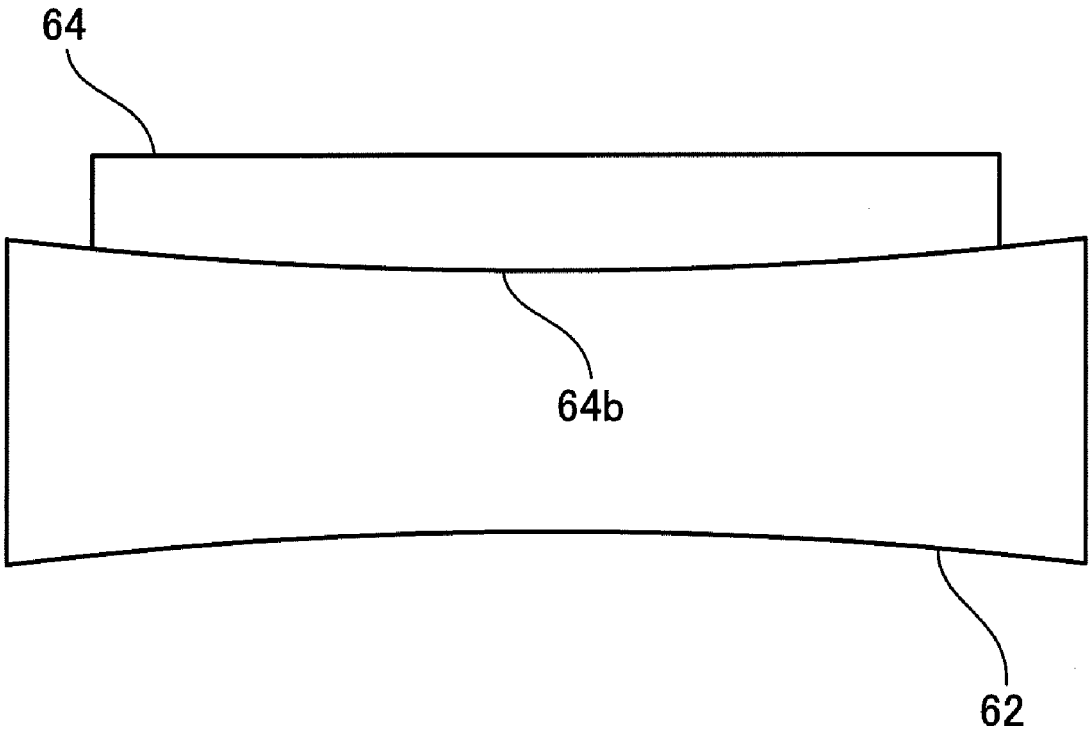
FIG. 4 illustrates a stripping pad and a pressure roll.

FIG. 4 illustrates the stripping pad 64 and the pressure roll 62. The figure shows the stripping pad 64 and the pressure roll 62 as the fixing device 60 is viewed in a direction of arrow G in FIG. 2A. In the figure, illustration of the fixing belt 610 and the like is omitted.

The pressure roll 62 has substantially flare portions, in which a diameter (an outer diameter) at the center portion (the center portion in the axial direction) is smaller than that at both end portions, although this has been omitted in the above description. In other words, the pressure roll has a larger diameter toward both end portions. With such a configuration of the pressure roll 62, a tensile force is exerted on the sheet in the nip portion N, thereby causing the sheet less wrinkled.

The pressing surface 64*b* of the stripping pad 64 is formed to follow the surface of the pressure roll 62. In addition, in the pressing surface 64*b* of the stripping pad 64, the center portion (the center portion in the longitudinal direction of the stripping pad 64) is positioned curving toward the pressure roll 62 compared to the end portions (the end portions in the longitudinal direction of the stripping pad 64), thereby forming the stripping pad 64 to have substantially a crown portion. To explain in further detail, the pressing surface 64*b* of the stripping pad 64 is formed as substantially an arc so that the pressing surface 64*b* is curved toward the pressure roll 62 along with a move from both end portions to the center portion in the longitudinal direction of the stripping pad 64.

The pressing surface 64*b* of the stripping pad 64 may be formed flat, but the pressure in the pad mounted area N2T is decreased toward the center portion (the center portion in the longitudinal direction) of the stripping pad 64 in this case. In this exemplary embodiment, as described above, the water vapor suppressed in the roll nip portion N1 may occur in the boundary area N2S in some cases, and there may be a possibility of occurrence of image defect when the water vapor enters the pad mounted area N2T. If the pressing surface 64*b* of the stripping pad 64 is formed flat and the pressure roll 62 is formed with flare portions, the pressure in the pad mounted area N2T is decreased toward the center portion of the stripping pad 64. In this case, the water vapor tends to enter the pad mounted area N2T at the center portion of the stripping pad 64. Then the water vapor readily concentrates on specific parts and image defect tends to occur with a larger scale.

Therefore, in the stripping pad 64 in this exemplary embodiment, the pressing surface 64*b* is formed to follow the surface of the pressure roll 62 as described above to make the pressure applied between the stripping pad 64 and the pressure roll 62 (pressure applied in the pad mounted area N2T) substantially constant throughout the stripping pad 64 in the longitudinal direction. In this case, the water vapor occurred in the boundary area N2S does not concentrate on specific parts, but is dispersed in the longitudinal direction of the stripping pad 64. As a result, though in the case where the image defect supposedly occurs, the scale of the defect may be smaller. In short, the image defect may be less conspicuous.

Figure 5:
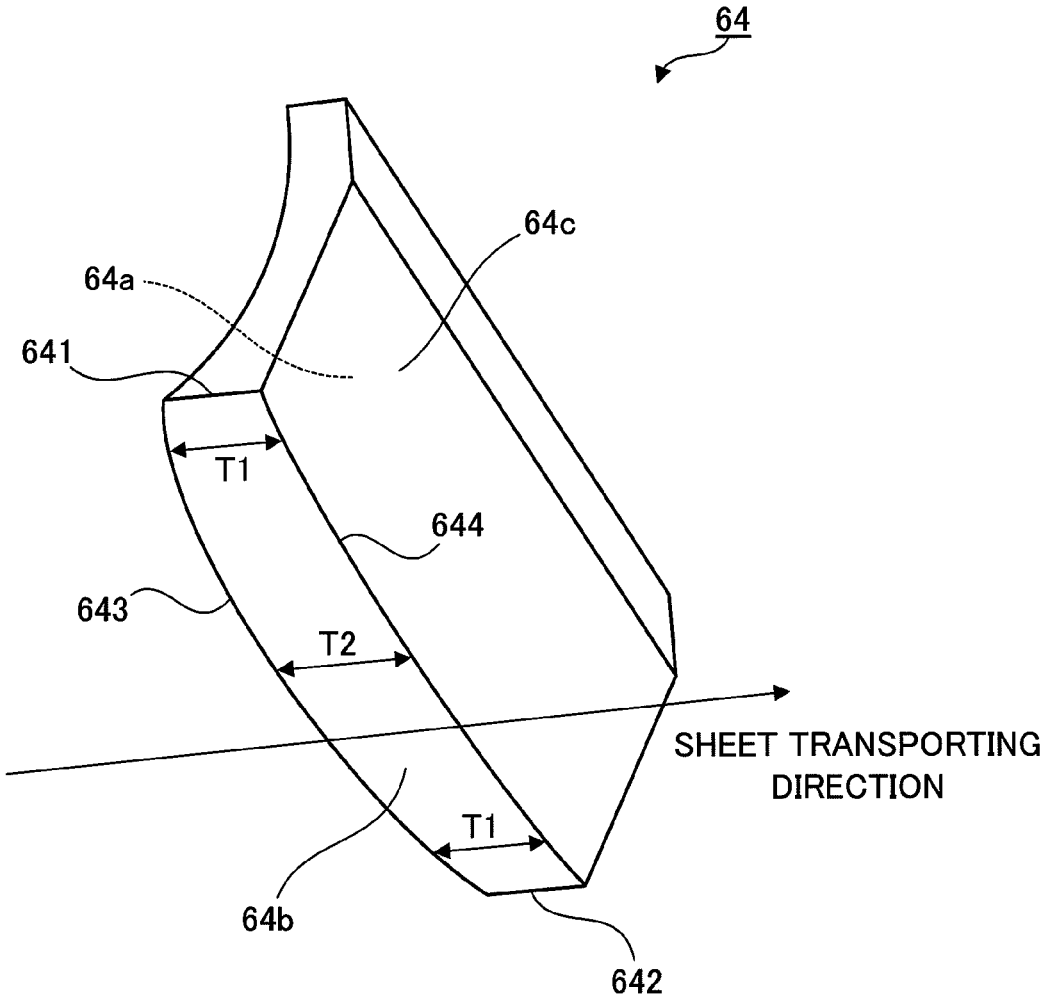
FIG. 5 is a perspective view showing the stripping pad as viewed from beneath.

FIG. 5 is a perspective view showing the stripping pad 64 as viewed from beneath.

In the stripping pad 64 in this exemplary embodiment, the pressing surface 64*b* is formed to follow the surface of the pressure roll 62, as described above. To explain again with reference to FIG. 5, the pressing surface 64*b* is formed as substantially an arc (with a curvature) to be curved toward the pressure roll 62 along with a move from both end portions to the center portion of the stripping pad 64. In other words, the pressing surface 64*b* is formed to have the center portion protruding downwardly than both end portions.

The pressing surface 64*b* of the striping pad 64 in this exemplary embodiment has, as shown in the figure, a first side 641 at an end and a second side 642 at the other, opposite end in the longitudinal direction of the stripping pad 64. The pressing surface 64*b* also has a third side 643 at an upstream end (in the proximity of the fixing roll 611) and a fourth side 644 at a downstream end in the sheet transporting direction of the stripping pad 64. That is, the pressing surface 64*b* of the stripping pad 64 is enclosed with plural sides, the first side 641 to the fourth side 644.

In this exemplary embodiment, the third side 643 is formed as substantially an arc. Specifically, the third side 643 is formed to have a curvature to be curved toward the upstream side of the sheet transporting direction (fixing roll 611 side). In other words, in the third side 643, the center portion is disposed closer to the fixing roll 611 than both end portions in the longitudinal direction. The distance between the fixing roll 611 and the third side 643 is shortest at the center portion and becomes longer at both end portions of the stripping pad 64 in the longitudinal direction thereof. To explain further in detail, in the case where the distance between the third side 643 and the fourth side 644 at the center portion of the stripping pad 64 in the longitudinal direction thereof is set to T2, the distance between the third side 643 and the fourth side 644 at the end portion of the stripping pad 64 in the longitudinal direction thereof is T1, which is shorter than T2. In this exemplary embodiment, further, the third side 643 is formed as substantially an arc; accordingly, the width of the pressing surface 64*b* (the width in the moving direction of the fixing belt 610) is different at the center portion and the end portion of the stripping pad 64. Specifically, in this exemplary embodiment, the width of the pressing surface 64*b* becomes narrower along with a move from the center portion to the end portion in the longitudinal direction of the stripping pad 64.

Figure 6:
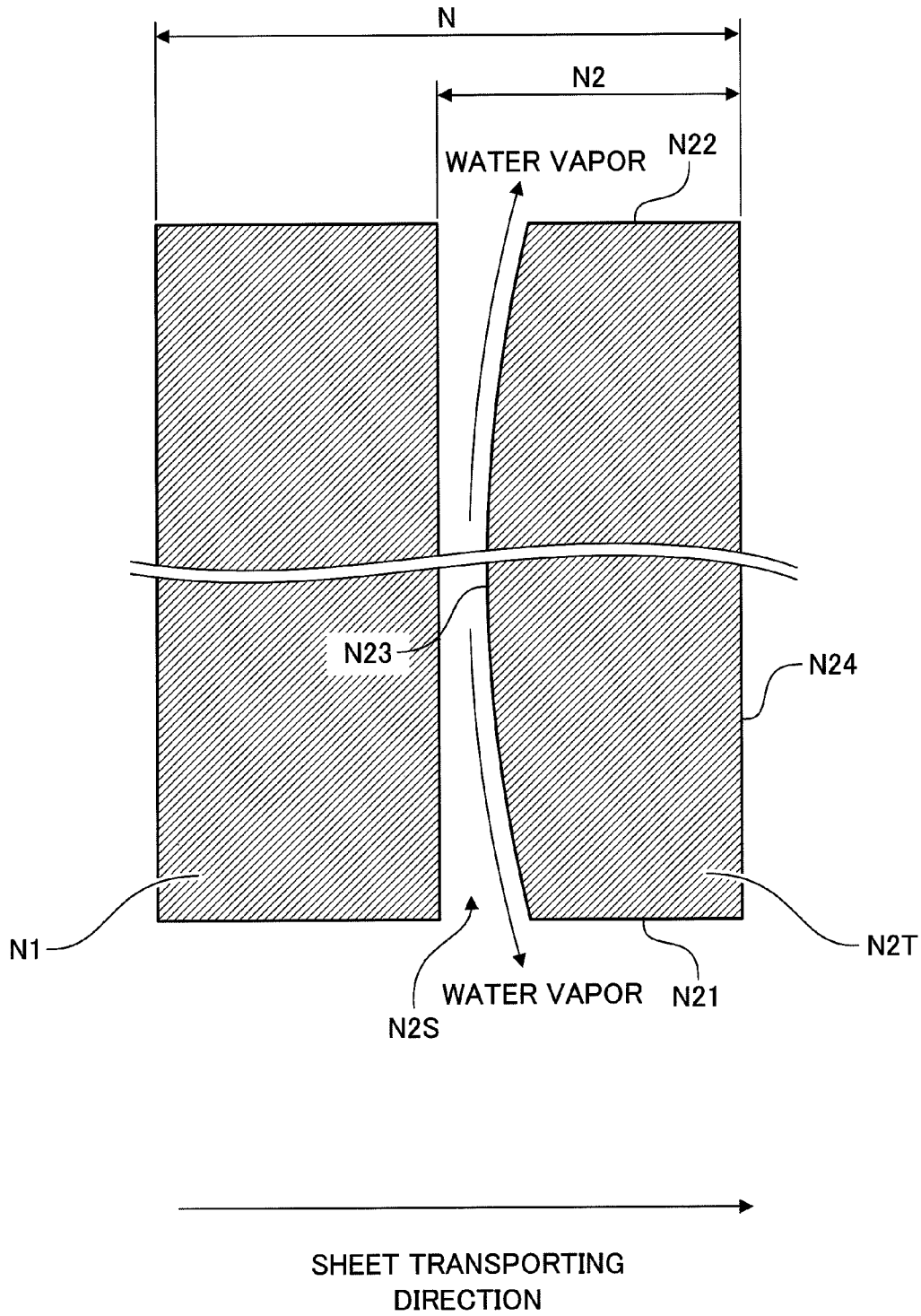
FIG. 6 illustrates a shape of a pad mounted area.

FIG. 6 illustrates a shape of the pad mounted area N2T. Specifically, the figure illustrates the shape of the pad mounted area N2T shown in FIG. 3A as viewed from above, with the shape of the roll nip portion N1.

In this exemplary embodiment, as described above, the roll nip portion N1 having a substantially rectangular shape is formed by the fixing roll 611 and the pressure roll 62, and the pad mounted area N2T is formed by the stripping pad 64 and the pressure roll 62 at the downstream side of the roll nip portion N1 in the sheet transporting direction.

The pressing surface 64*b* of the stripping pad 64 has four sides, the first side 641 to the fourth side 644, as described above. Accordingly, the pad mounted area N2T has a first side N21 to a fourth side N24 corresponding to the respective four sides in the pressing surface 64*b*. Further, in this exemplary embodiment, the third side 643 of the pressing surface 64*b* is formed as substantially an arc to approach at the center portion thereof the fixing roll 611 as described above. Therefore, the third side N23 of the pad mounted area N2T is also formed as substantially an arc to approach, at the center portion thereof, the fixing roll 611.

Specifically, the third side N23 of the pad mounted area N2T is formed with a curvature such that the center portion of the third side N23 approaches the roll nip portion N1. In other words, the third side N23 is formed to be more separated from the roll nip portion N1 along with a move from the center portion to the end portion. The distance between the roll nip portion N1 and the pad mounted area N2T becomes longest at an end portion (an end portion in the direction orthogonal to the sheet transporting direction) of the stripping pad nip portion N2, and shortest at a center portion (a center portion in the direction orthogonal to the sheet transporting direction) of the stripping pad nip portion N2.

In this exemplary embodiment, as described above, the water vapor suppressed in the roll nip portion N1 may occur in the boundary area N2S, and there may be a possibility of occurrence of image defect when the water vapor enters the pad mounted area N2T. However, in this exemplary embodiment, the third side N23 of the pad mounted area N2T is formed as substantially an arc such that the third side N23 is gradually separated from the roll nip portion N1 along with a move from the center portion to the end portion of the third side N23. Accordingly, the water vapor occurred in the boundary area N2S tends to move toward both end portions of the boundary area N2S (both end portions of the stripping pad 64), as shown in FIG. 6. After moving to both end portions of the stripping pad 64, the water vapor is discharged from the boundary area N2S, thereby, in this case, preventing the water vapor from entering the pad mounted area N2T. Accordingly, the image defect is less likely to occur.

In this exemplary embodiment, since the stripping pad 64 is supported at both ends thereof, deformation of the stripping pad 64 occurs; and therefore the pressure tends to be decreased at the center portion of the stripping pad 64. As a result, the pressure is also decreased at the center portion (the center portion in the direction orthogonal to the sheet transporting direction) in the boundary area N2S; and therefore the water vapor tends to occur at the center portion. Accordingly, an amount of water vapor which enters the center portion of the pad mounted area N2T increases, thereby easily causing the image defect at a center portion of a sheet.

In the case where the center portion of the third side 643 (or the third side N23) is approaching the fixing roll 611 as described above, the pressure drop at the center portion of the boundary area N2S is suppressed compared to the case where the third side 643 is formed to be linear. As a result, occurrence of the water vapor at the center portion of the boundary area N2S is inhibited, and the water vapor hardly enters the center portion of the pad mounted area N2T. In this case, the image defect is rarely caused at the center portion of a sheet.

In the above description, the case where the outer peripheral surface of the pressure roll 62 is formed to have substantially flare portions is taken as an example. Even though the outer peripheral surface of the pressure roll 62 is formed to be linear, without flare portions, occurrence of the image defect is suppressed by making the center portion of the pressing surface 64*b* of the stripping pad 64 to be curved toward the pressure roll 62.

The stripping pad 64 in this exemplary embodiment is supported at both ends thereof as described above; therefore, the pressure is likely to be decreased at the center portion of the stripping pad 64. In this case, the water vapor occurred in the boundary area N2S tends to enter the pad mounted area N2T at the center portion (the center portion in the direction orthogonal to the sheet transporting direction) thereof. However, if the pressing surface 64*b* of the stripping pad 64 is curved at the center portion thereof toward the pressure roll 62, the pressure at the center portion of the pad mounted area N2T is increased. As a result, even in this case, the water vapor hardly concentrates on a specific region, thus not easily causing the image defect.

Figure 7A:
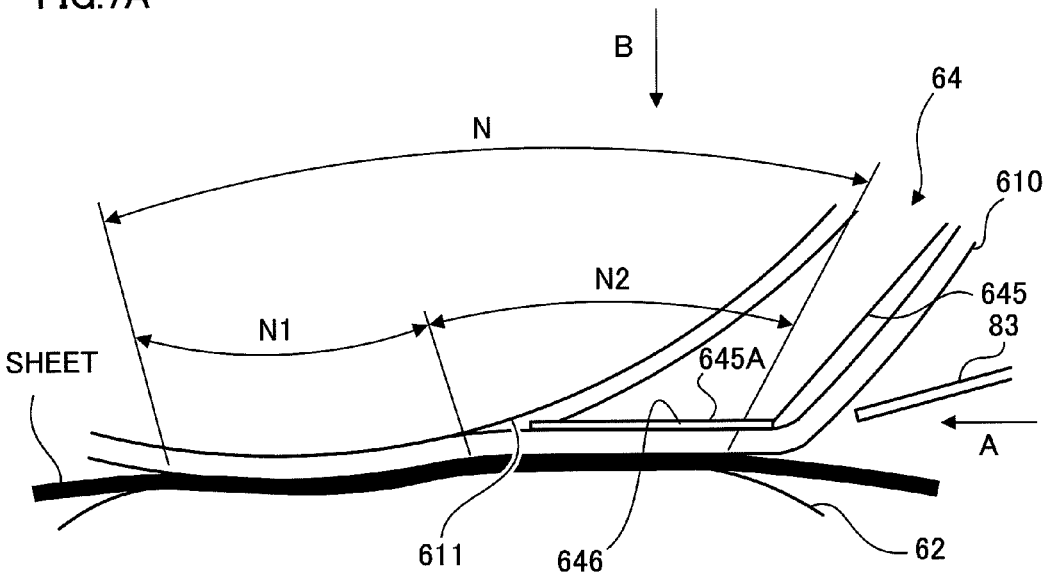
FIGS. 7A to 7C illustrate a modification of the stripping pad.
Figure 7B:
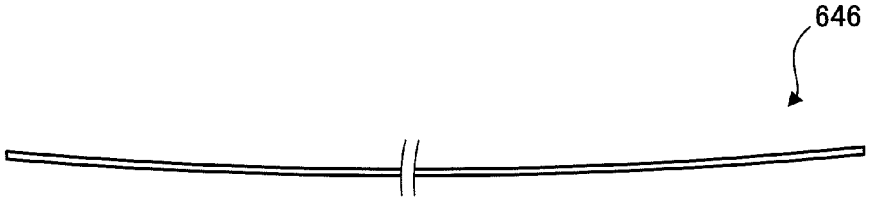
Figure 7C:
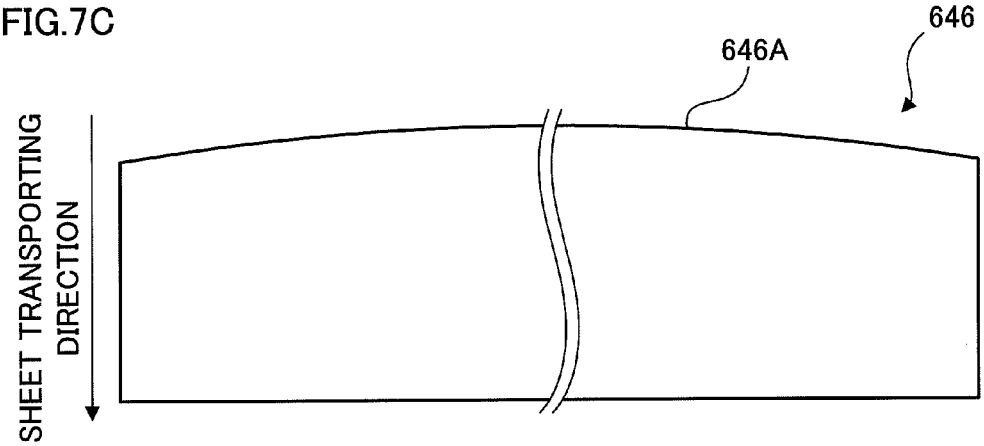

The stripping pad 64 may have a configuration as shown in FIGS. 7A to 7C.

FIGS. 7A to 7C illustrate a modification of the stripping pad 64. FIG. 7B shows a plate member 646 (described later) as viewed in a direction of arrow A in FIG. 7A, and FIG. 7C shows the plate member 646 as viewed in a direction of arrow B in FIG. 7A.

The stripping pad 64 in this modification is, as shown in FIG. 7A, composed of a main portion 645 (an example of a main body of a pressing member) having a form similar to that of the stripping pad 64 shown in FIGS. 2A and 2B, and a plate member 646 attached on a lower surface 645A (facing the inner peripheral surface of the fixing belt 610) of the main portion 645. The plate member 646 has a shape similar to that of the pressing surface 64*b*.

To be more specific, the plate member 646 is disposed along the longitudinal direction of the stripping pad 64, and formed with a curve so that the center potion in the longitudinal direction thereof is curved toward the pressure roll 62 than the end portion thereof in the longitudinal direction as shown in FIG. 7B. With such a configuration, the pressure drop at the center portion (the center portion in the direction orthogonal to the sheet transporting direction) of the pad mounted area N2T is suppressed. The lower surface 645A of the main portion 645, to which the plate member 646 is attached, has a shape following the shape of the plate member 646.

The plate member 646 is formed with a substantially rectangular shape, and as shown in FIG. 7C, provided with a facing side 646A that faces the fixing roll 611 at the upstream side end thereof in the sheet transporting direction. In this modification, the facing side 646A is formed with a curvature. More specifically, the facing side 646A is formed as substantially an arc so that the center portion thereof in the longitudinal direction is positioned in the proximity of the fixing roll 611 compared with the end portion thereof in the longitudinal direction. Further, in other words, similar to the third side 643 (refer to FIG. 5) formed in the pressing surface 64*b*, the facing side 646A approaches the fixing roll 611 along with a move from the end portion to the center portion thereof.

With such a configuration, similar to the case where the pressing surface 64*b* is provided with the third side 643, the water vapor occurred in the boundary area N2S readily moves to the end portion (the end portion in the direction orthogonal to the sheet transporting direction) of the boundary area N2S. Further, the pressure drop at the center portion (the center portion in the direction orthogonal to the sheet transporting direction) of the boundary area N2S is suppressed; and therefore, the water vapor hardly occurs at the center portion. As a result, the image defect tends not to be caused.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member provided to be circularly movable having a width;

a first fixing member disposed inside the belt member;

a second fixing member that is disposed to be in press contact with the first fixing member across the belt member, and forms a passing portion between the belt member and the second fixing member, through which a recording medium passes; and a pressing member that is disposed along a direction of the width of the belt member and disposed downstream of the passing portion in a moving direction of the belt member, the pressing member having a surface configured to contact an inner peripheral surface of the belt member to press the belt member against the second fixing member, wherein the surface is curved to extend further toward the second fixing member when moving from an end portion to a center portion in a longitudinal direction of the pressing member, wherein the surface of the pressing member does not move in the downstream direction.

2. The fixing device according to claim 1, wherein the surface, which is curved toward the second fixing member along with the move from the end portion to the center portion in the longitudinal direction of the pressing member, is formed with a curvature.

3. The fixing device according to claim 1, wherein the second fixing member is disposed along the width direction of the belt member and rotatable, and an outer diameter of the second fixing member becomes larger along with a move from a center portion to an end portion in a longitudinal direction of the second fixing member.

4. The fixing device according to claim 1, wherein the pressing member at least comprises a main body positioned inside the belt member and a plate member positioned between the main body and the inner peripheral surface of the belt member, the plate member being in contact with the inner peripheral surface of the belt member and constituting the surface of the pressing member.

5. The fixing device according to claim 1, wherein a surface of the first fixing member is configured to rotate.

6. A fixing device comprising:

a belt member provided to be circularly movable having a width;

a first fixing member disposed inside the belt member;

a second fixing member that is disposed to be in press contact with the first fixing member across the belt member, and forms a passing portion between the belt member and the second fixing member, through which a recording medium passes; and a pressing member that is disposed along a direction of the width of the belt member and disposed downstream of the passing portion in a moving direction of the belt member, the pressing member having a surface enclosed by a plurality of sides including a side positioned in the proximity of the first fixing member and configured to contact an inner peripheral surface of the belt member to press the belt member against the second fixing member, wherein the side positioned in the proximity of the first fixing member among the plurality of sides is further apart from the first fixing member when moving a center portion to an end portion in a longitudinal direction of the side.

7. The fixing device according to claim 6, wherein the side positioned in the proximity of the first fixing member among the plurality of sides is formed as substantially an arc.

8. The fixing device according to claim 6, wherein the second fixing member is disposed along the width direction of the belt member and rotatable, and an outer diameter of the second fixing member becomes larger along with a move from a center portion to an end portion in a longitudinal direction of the second fixing member.

9. The fixing device according to claim 6, wherein the pressing member at least comprises a main body positioned inside the belt member and a plate member positioned between the main body and the inner peripheral surface of the belt member, the plate member being in contact with the inner peripheral surface of the belt member and constituting the surface of the pressing member.

10. The fixing device according to claim 6, wherein a surface of the first fixing member is configured to rotate.

11. An image forming apparatus comprising:

an image forming unit that forms an image on a recording medium; and a fixing unit that fixes the image on the recording medium, the image having been formed thereon, wherein the fixing unit comprises:

a belt member provided to be circularly movable having a width;

a first fixing member disposed inside the belt member;

a second fixing member that is disposed to be in press contact with the first fixing member across the belt member, and forms a passing portion between the belt member and the second fixing member, through which the recording medium carrying the image formed by the image forming unit passes; and a pressing member that is disposed along a direction of the width of the belt member and has a pressing surface that presses an inner peripheral surface of the belt member at a position downstream of the first fixing member in a moving direction of the belt member to press the belt member against the second fixing member, wherein the pressing surface is curved further toward the second fixing member when moving from an end portion to a center portion in a longitudinal direction of the pressing member, wherein the pressing surface of the pressing member does not move in the downstream direction.

12. The image forming apparatus according to claim 11, wherein the pressing surface is enclosed by a plurality of sides including a side positioned in the proximity of the first fixing member, and wherein the side positioned in the proximity of the first fixing member among the plurality of sides is more apart from the first fixing member along with a move from a center portion to an end portion in a longitudinal direction of the side.

13. The image forming apparatus according to claim 11, wherein a surface of the first fixing member is configured to rotate.

14. An image forming apparatus comprising:

an image forming unit that forms an image on a recording medium; and a fixing unit that fixes the image on the recording medium, the image having been formed thereon, wherein the fixing unit comprises:

a belt member provided to be circularly movable having a width;

a first fixing member disposed inside the belt member;

a second fixing member that is disposed to be in press contact with the first fixing member across the belt member, and forms a passing portion between the belt member and the second fixing member, through which the recording medium carrying the image formed by the image forming unit passes; and a pressing member that is disposed along a direction of the width of the belt member and has a pressing surface that presses an inner peripheral surface of the belt member at a position downstream of the first fixing member in a moving direction of the belt member to press the belt member against the second fixing member, wherein a width of the pressing surface of the pressing member in the moving direction of the belt member becomes narrower when moving from a center portion to an end portion in a longitudinal direction of the pressing member, wherein the pressing surface of the pressing member does not move in the downstream direction.

15. The image forming apparatus according to claim 14, wherein the pressing surface is enclosed by a plurality of sides including a side positioned in the proximity of the first fixing member, and wherein the side positioned in the proximity of the first fixing member among the plurality of sides is more apart from the first fixing member along with a move from a center portion to an end portion in a longitudinal direction of the side.

16. The image forming apparatus according to claim 14, wherein a surface of the first fixing member is configured to rotate.

* * * * *